United States Patent [19]

Turnbull et al.

[11] 4,053,806

[45] Oct. 11, 1977

[54] PYROELECTRIC DETECTOR COMPRISING NUCLEATING MATERIAL WETTABLE BY AQUEOUS SOLUTION OF PYROELECTRIC MATERIAL

[75] Inventors: Andrew Alfred Turnbull, Reigate; Harry Sewell, Horsham, both of England

[73] Assignee: U.S. Philips Corporation, New York, N.Y.

[21] Appl. No.: 609,449

[22] Filed: Sept. 2, 1975

[30] Foreign Application Priority Data

Sept. 2, 1974 United Kingdom ..... 38214/74

[51] Int. Cl.[2] ..... H01J 29/45; H01J 31/49; H01J 39/00

[52] U.S. Cl. ..... 313/388; 313/101

[58] Field of Search ..... 313/388, 101; 250/333

[56] References Cited

U.S. PATENT DOCUMENTS

| | | | |
|---|---|---|---|
| 2,866,918 | 12/1958 | Hansen | 313/388 X |
| 2,999,177 | 9/1961 | Null et al. | 313/388 |
| 3,034,010 | 5/1962 | Garbuny | 313/101 |
| 3,054,917 | 9/1962 | Eberhardt | 313/388 |
| 3,495,117 | 2/1970 | McNally | 313/388 |
| 3,517,246 | 6/1970 | Chester et al. | 313/101 X |
| 3,641,346 | 2/1972 | Lachambre | 313/101 X |
| 3,825,791 | 7/1974 | Kazan | 313/398 |
| 3,885,187 | 5/1975 | Schnitzler | 313/101X |
| 3,909,654 | 9/1975 | Conklin et al. | 313/388 |
| 3,930,157 | 12/1975 | Walton | 313/388 X |
| 3,946,264 | 3/1976 | Crowell | 313/388 |

FOREIGN PATENT DOCUMENTS

| | | | |
|---|---|---|---|
| 1,395,741 | 5/1975 | United Kingdom | 313/388 |

*Primary Examiner*—Robert Segal

*Attorney, Agent, or Firm*—Frank R. Trifari; Carl P. Steinhauser

[57] ABSTRACT

A pyroelectric detector employing a substrate supporting a thin, i.e., 0.5 to 5 μm thick, solid layer of pyroelectric material with an intermediate layer of nucleating material, i.e., a material which is wettable by a solution of the pyroelectric material so that an adherent continuous layer is formed thereon. The pyroelectric layer may be in the form of a mosaic of islands separated by an electrically conductive material covered with an electrically insulating material.

12 Claims, 8 Drawing Figures

PYROELECTRIC DETECTOR COMPRISING NUCLEATING MATERIAL WETTABLE BY AQUEOUS SOLUTION OF PYROELECTRIC MATERIAL

This invention to pyroelectric detectors, to pyroelectric targets for thermal-image camera tubes, and to methods of making such detections and targets.

A pyroelectric material, such as triglycine sulphate (commonly abbreviated to TGS), is a material capable of producing between opposite surfaces of a portion of the material an electric current proportional to the rate of change of temperature of the material. Since such materials are generally good insulators, a pyroelectric detector may comprise a portion of pyroelectric material with electrodes provided adjacent said surfaces: when the temperature of the material changes, a potential difference is produced between the electrodes owing to changing of the portion of material, and the voltage may be determined after amplification by a sensitive, low-noise, high input-impedance amplifer.

For a detector to have high sensitivity, it is desirable that it should have a low thermal capacity, and hence that the thickness of the pyroelectric material should be small. The signal-to noise ratio also improves as the thickness decreases. Conventional detectors have commonly comprised a single crystal of pyroelectric material having a thickness of at least 20 $\mu$. It has been proposed (see U.K. Specification No. 1,233,162) to provide a detector comprising a matrix consisting of a film of a plastic binder having a thickness of at least 10 $\mu$ and having uniformly held therein microcrystals of a pyroelectric material having a particle size of 3 $\mu$ to 100 $\mu$. The effective dilution of the pyroelectric material will of course reduce the available output signal.

A thermal-image camera tube may have a target comprising a pyroelectric detector. A thermal-image camera tube and its manner of operation is described in an article in J. Phys. D: Appl. Phys., 1971, 4 (No. 12), pages 1898–1909, "Thermal-imaging camera tubes with pyroelectric targets" by B. R. Holeman and W. M. Wreathall; the article includes a theoretical analysis of characteristics of the target. The tube described largely resembles a conventional magnetic deflection and focus vidicon camera tube in which a target exposed to radiation from the scene being viewed is scanned by an electron beam, the main difference being that the conventional photoconductive target plate is replaced by a single-crystal slice of TGS having a thickness of at least 20 $\mu$ and bearing a thin electrically conductive layer which for operation is connected via an indium vacuum seal to an external camera head amplifier. The tube has an entrance window of a material which is of course transparent to radiation of the wavelengths of interest.

Because a pyroelectric material produces an electric current only while its temperature is changing, it is necessary in order to obtain a persistent image from such a tube that the radiation input be varied with time. This may be done, for example, by chopping the radiation in synchronism with the frame scan, so that the chopping period is equal to, or an integral multiple of, the frame period. The pyroelectric material is thus alternately heated and cooled during successive halves of the chopping cycle, producing signal currents of opposite polarities; by inverting the signals produced during one set of alternate half-cycles, a continuous image can be produced. An alternative method of varying the radiation input is to continuously "pan" the camera across the scene being viewed.

The resolution and the modulation transfer function (MTF) of a pyroelectric target are dependent inter alia on its thermal diffusivity (thermal conductivity divided by volume specific heat): these characteristics improve as the diffusivity decreases.

It has been proposed (see U.K. Specification No. 1,395,741)to improve the resolution obtainable from a thermal-image camera tube by using a target comprising an array of spaced detector elements of TGS, each of the elements having a square base of side 50 $\mu$ and a thickness of 20 $\mu$, adjacent elements being separated by a gap of 10 $\mu$, and all the elements being attached by adhesive to a support of low thermal conductivity, such as a plastic sheet a few microns thick. The division of the active target surface into spaced separate elements inhibits the lateral conduction of heat.

The previously-mentioned U.K. Specification No. 1,233,162 also proposes a target comprising a mosaic of tiny areas formed by spraying a uniform dispersion of the TGS microcrystals in a solution of a film-forming substance onto a substrate, such as a plastic film 4$\mu$ thick, through a very fine mask; any array of detectors each consisting of the above-mentioned matrix is thus produced.

The present invention provides a pyroelectric detector and a pyroelectric target each comprising a substrate supporting a layer of pyroelectric material substantially thinner than previously proposed layers; the layer suitably consists substantially entirely of pyroelectric material, without any binder. The substrate is suitably a membrane which may also be substantially thinner than substrates previously proposed for the purpose. The invention further provides a method of making a pyroelectric detector and a pyroelectric target in which no adhesive is required to attach the layer of pyroelectric material to the substrate.

According to a first aspect of the invention, a pyroelectric detector comprises a substrate supporting a layer of pyroelectric material, the layer having a thickness substantially in the range of 0.5 –5 $\mu$.

According to a second aspect of the invention, a pyroelectric detector comprises a substrate supporting a detector element in the form of a continuous layer which consists substantially entirely of pyroelectric material and which has a thickness substantially in the range of 0.5 –5 $\mu$.

According to a third aspect of the invention, a pyroelectric detector comprises a substrate supporting a detector element in the form of a layer which consists substantially entirely of pyroelectric material, which has a thickness perpendicular to the substrate substantially in the range of 0.5 –5 $\mu$, and which has a width parallel to the substrate substantially greater than 5 $\mu$.

According to a fourth aspect of the invention, a pyroelectric detector comprises a substrate supporting a first layer of nucleating material, as herein defined, and a second layer of solid pyroelectric material formed from a solution thereof contacted with the first layer, the first layer being intermediate the second layer and the substrate. The thickness of the layer of pyroelectric material is suitably substantially in the range of 0.5 –5 $\mu$.

For the purposes of this specification, a "layer of nucleating material" is to be understood to mean a layer of material the surface of which layer is wettable by a solution of pyroelectric material (i.e., the solution can form a continuous film on the surface, rather than discrete droplets) and which hence, as the solution cools and/or the solvent evaporates, resulting in crystallisation of the pyroelectric material, tends to promote the formation on the surface of a continuous, adherent layer of solid pyroelectric material.

Suitable materials for example for an aqueous solution of TGS are aluminum, titanium, matt carbon, magnesium fluoride, aluminum oxide or silica; with aluminum or titanium, the effective surface of the material may be the thin oxide layer formed on the metal.

According to a fifth aspect of the invention, a pyroelectric target for a thermal-image camera tube comprises a detector embodying the first or fourth aspects of the invention, wherein said layer of pyroelectric material is in the fourth of a mosaic of spaced separate portions of pyroelectric material. The layer of nucleating material may be a continuous layer extending between adjacent portions of pyroelectric material.

According to a sixth aspect of the invention, a pyroelectric target for a thermal-image camera tube comprises a detector embodying the second or third aspects of the invention, wherein the target comprises a plurality of said detector elements forming a mosaic of spaced separate portions of pyroelectric material supported on a single said substrate.

In a detector or target embodying the invention, the substrate is suitably a membrane having a low thermal capacity, i.e., substantially smaller than that of the pyroelectric material, thus enhancing the sensitivity. The membrane suitably also has a low thermal conductance parallel to its surface on which the pyroelectric material is supported, i.e., substantially less than the thermal conductance of the pyroelectric material. This feature is particularly pertinent to a target, as it is one of the factors governing the rate of conduction of heat between adjacent portions of the mosaic of pyroelectric material, but may also be of some importance for a detector, in that it is undesirable for a substantial proportions of heat to be conducted to supporting means for the membrane, which means may act as a heat sink; this is of course of greatest significance when the radiation incident on the detector is chopped at a relatively low frequency.

The thickness of the membrane may for example be in the range of 0.05 -0.3 $\mu$, although both smaller and larger values are possible. The ratio $R_1$ of the thickness of the layer of pyroelectric material to the thickness of the membrane is suitably not substantially less than 10, and may be not substantially less than 20.

The membrane may consist of a synthetic plastics material, which is suitably a polyimide; this shows good strength, resilience, and temperature stability, has a low vapour pressure, and is little affected by water and hydrofluoric acid; these last two factors may be relevant to the method of making the detector or target.

The substrate may consist of an electrically conductive material but, for example, a plastics material such as polyacrylonitrile with added conductive material to make it conductive tends to be very brittle, especially when very thin. Therefore the substrate suitably consists of an electrically insulating material and supports a continuous layer of electrically conductive material, which may be contiguous with the substrate, and which is suitably intermediate the pyroelectric material and the substrate. The electrically conductive layer may alternatively be on the side of the substrate remote from the pyroelectric material, but this may of course result in a lower sensitivity owing to the series capacitance of the substrate.

In a detector or target embodying the fourth aspect of the invention, the electrically conductive layer may constitute the layer of nucleating material (for example if it consists of aluminum), or may be a distinct layer intermediate the layer of nucleating material and the substrate.

In a target in which the electrically conductive layer is intermediate the pyroelectric material and the substrate, the surfaces remote from the substrate of portions of the layer between adjacent portions of the pyroelectric material may be covered by electrically insulating material in order to prevent those surfaces from being "seen" by a scanning electron beam in a camera tube incorporating the target. The insulating material may also extend intermediate the portions of pyroelectric material and the electrically conductive layer to form a continuous layer; the layer of insulating material may then constitute the layer of nucleating material (for example if it consists of magnesium fluoride), or may be a distinct layer intermediate the layer of nucleating material and the layer of electrically conductive material. The electrically insulating material would of course not be required if the electrically conductive layer is on the side of the substrate remote from the pyroelectric material.

The layer of electrically conductive material may be adapted (for example by suitable choice of the material and/or its thickness) to absorb a substantial percentage of incident thermal radiation; this may be of particular significance in detectors or targets in which the wavelength of the radiation and/or the thickness of the pyroelectric material are such that the radiation is insufficiently absorbed by the latter material.

In a target embodying the invention, the mosaic suitably comprises a regular array of substantially uniform portions of pyroelectric material, which may be square. A width of each portion may be substantially in the range of 20–30 $\mu$m. The ratio $R_2$ between a width of each portion and a gap between adjacent portions is suitably not substantially less than 5 or substantially greater than 12; if the ratio is too high, the resolution and MTF will suffer owing to the low thermal resistance between adjacent portions, and if the ratio is too low, the sensitivity will suffer owing to the relatively large proportion of the surface area of the target not covered with pyroelectric material (the pyroelectric current being proportional to the surface area of the pyroelectric material).

The periphery of the membrane may be supported by a substantially rigid support, such as a metal ring. If necessary, the membrane may be further supported by a plurality of spaced supporting members bearing against a surface of the membrane opposite to that on which the pyroelectric material is supported, whereby to maintain tension in the membrane. Whether such further support is necessary will depend on the width of the membrane; the necessity appears to be significantly greater (in order to minimise microphony) for detectors than for targets.

According to a seventh aspect of the invention, a method of making a detector or target embodying the fourth or fifth aspects of the invention comprises the steps of forming said layer of nucleating material on said substrate and contacting the layer of nucleating material with said solution of pyroelectric material. The invention further provides a said method of making such a target wherein the layer of nucleating material is a continuous layer extending between adjacent portions of pyroelectric material, wherein the layer of nucleating material is substantially flat, wherein prior to contacting the layer of nucleating material with the solution, the layer is partially covered with further, non-nucleating material so as to leave uncovered a mosaic corresponding to the desired mosaic of pyroelectric material, and wherein subsequent to the formation of the mosaic of pyroelectric material, said further material is removed to leave gaps between adjacent portions of pyroelectric material. The invention alternatively provides a said method of making such a target wherein a free major surface of the substrate or of a layer supported thereon is partially covered with further material so as to leave uncovered a mosaic corresponding to the desired mosaic of pyroelectric material, wherein the layer of nucleating material is formed on said further material and on the uncovered portions of said surface, and wherein subsequent to contacting the layer of nucleating material with said solution, said further material is removed together with material overlying it so as to form the mosaic of pyroelectric material with gaps between adjacent portions thereof. The partial covering of said further material is suitably provided by photolithography.

When the substrate is a membrane, the membrane is suitably formed on a first rigid support which is subsequently removed, suitably after the periphery of the membrane has been secured to a second rigid support. The layer of nucleating material may be contacted with the solution of pyroelectric material after the first support has been removed; suitably, the layer of nucleating material is formed after the first support has been removed.

Embodiments of the invention will now be described, by way of example, with reference to the accompanying diagrammatic drawings, in which:

FIGS. 1*a* to 1*f* show various stages in a method of making a pyroelectric target, the method and the target each embodying the invention;

Figure 1A:
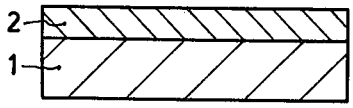
Figure 1D:
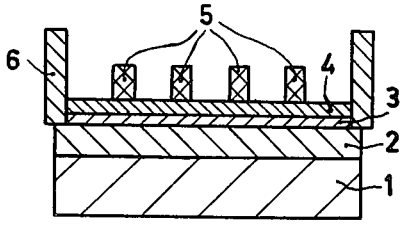
Figure 1B:
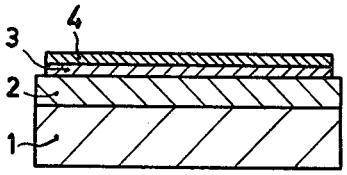
Figure 1E:
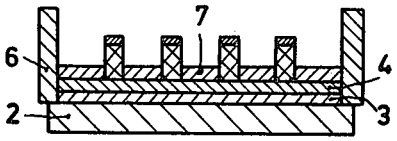
Figure 1C:
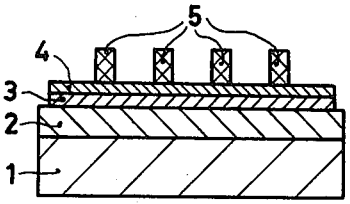
Figure 1F:
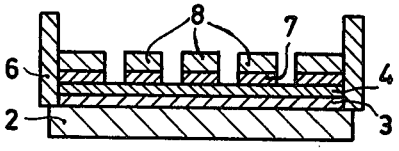

A method of making a pyroelectric target embodying the invention will be described with reference to FIG. 1. A solution of a polyimide resin was prepared by mixing one volume of PYRE-M.L. (Trade Mark, Du-Pont Co.) wire enamel with two volumes of N-methyl-2-pyrrolidone. A small quantity of this solution was placed on a glass microscope cover slip 1 (FIG. 1*a*) having a diameter of 19 mm and thickness of 0.1 mm; the glass slip has a suitably smooth surface for the formation of a thin plastics film. A film of the solution was formed by spinning the cover slip 1 at about 10,000 r.p.m. in air at room temperature for 1 minute. The film was then dried by spinning for a further minute under a hair drier, reaching a maximum temperature of about 70° C.

The cover slip with the dry film 2 was transferred to a vacuum-deposition unit, and layers 3 and 4 (FIG. 1*b*) respectively of nickel-chromium alloy having a thickness of about 250 A and a resistance of the order of 1000 ohms per square, and of magnesium fluoride, having a thickness of approximately 250 A, were successively evaporated onto the plastic film. The cover slip was taken out of the unit, and the plastics film was cured by heating in an atmosphere of commercial-grade "oxygen-free" nitrogen at 400° C for 1 hour.

It has been found that the adhesion of the evaporated layers to the plastics film is improved by curing the plastics material subsequent, rather than prior, to the deposition of the layers. It has furthermore been found that if the curing process is carried out after the nickel-chromium alloy layer has been deposited but before an overlying layer is provided on it, the alloy layer disappears. It is thought that this may be due to oxidation of the very thin layer of alloy by minute quantities of oxygen present in the nominally "oxygen-free" nitrogen, and consequently that the effect may not occur if the concentration of oxygen is reduced to a sufficiently low level. It should also be borne in mind that oxygen tends to disrupt the polymers bonds in the plastics material at high temperatures and hence to reduce the strength of the cured membrane.

The thickness of the resulting cured plastics membrane was approximately 0.1 μm. Different thicknesses can of course be obtained by varying the concentration and hence viscosity of the resin solution which is deposited on the glass slip and/or by varying the speed at which the slip is then spun, the former having a proportionally more marked effect than the latter.

The magnesium fluoride layer 4 was then coated with a layer of Shipley AZ 340 photoresist which was dried and exposed to ultra-violet light through a mask in contact with the photoresist so as to produce after development in Shipley AZ 303 developer a regular grid of orthogonal lines 5 (FIG. 1*c*) about 4 μm wide, spaced at regular intervals of bout 30 μm, and about 5 μm thick.

The initial photoresist coating can be provided by the spinning technique conventionally used in semiconductor technology, but we have found that, particularly when relatively large thicknesses are required, this method tends to result in a greater thickness near the periphery of the substrate than at its center, and the lack of intimate contact over the whole substrate between the mask and the photoresist during the subsequent exposure results in some degradation of edge definition of the grid lines. It appears that better results may be obtained by spraying the undiluted photoresist solution onto the substrate, for example with an AEROGRAPH (Trade Mark) compressed-gas spray gun. A relatively large thickness of the layer also makes the use of a relatively low absorption-index photoresist (such as that mentioned above) desirable.

A metal washer 6 (FIG. 1*d*) having external and internal diameters of 22 mm and 17.5 mm respectively was now cemented to the side of the substrate remote from the cover slip with ARALDITE (Trade Mark) epoxy resin adhesive (not shown), and the cover slip 1 was carefully removed by etching in a 40% by weight aqueous solution of hydrofluoric acid. The metal of the washer must of course be resistant to attack by hydrofluoric acid, for example cupro-nickel. After being washed thoroughly and dried, the assembly was again put in a vacuum-deposition unit, and an aluminum nucleating layer 7 (FIG. 1*e*) having a thickness of about 280 A was evaporated onto the uncovered portions of the magnesium fluoride layer and the photoresist grid. The assembly was removed from the unit, and a small quantity of a saturated (approximately 50%) aqueous solution of triglycine sulphate at 60° C was put on the aluminum layer. The assembly was spun at 1500 r.p.m. for about a minute under a hair-drier producing a maximum temperature of about 70° C, resulting in the formation of a polycrystalline layer of TGS in the spaces between the grid lines 5.

The photoresist was now removed by dissolving it in amyl acetate (in which TGS is insoluble), lifting off overlying aluminum (analogous to the "lift-off" technique of semiconductor technology) and leaving a mosaic of spaced, square portions 8 (FIG. 1*f*) of TGS, each having a width of some 26 μm and a thickness of about 2 μm, adhering to the underlying aluminum.

The above-described target may be used in a thermal-image camera tube in which a resolution of 7 line pairs per mm is required, with incident radiation chopped at a frequency of 25 Hz.

The maximum thickness of the TGS which can be obtained will of course depend inter alia on the thickness of the photoresist grid lines 5, the spaces between which are filled by the solution of TGS deposited on the nucleating layer.

It is not essential that the layer of nucleating material be provided after the grid of photoresist lines has been formed; the above-described method, in which the photoresist grid is formed on a flat layer of material (magnesium fluoride) which is itself nucleating, may be modified by omitting the step of evaporating the aluminum layer. However, the "wettability" of the layer of nucleating material which is partially covered by the photoresist may be degraded by contamination during processing steps intermediate the provision of the nucleating layer and the contacting therewith of the solution of pyroelectric material; the possiblity of contamination will obviously be minimised if the solution can be contacted with the layer of nucleating material immediately after its formation. Degradation of wettability may tend to result in a non-uniform layer of pyroelectric material, possibly to the extent of there being no pyroelectric material in certain portions of the desired mosaic.

The thickness of the layer of nucleating material may be as low as about 0.01 μm (particularly when it is formed immediately above a layer which is itself nucleating, as described above); the thickness should preferably not exceed 0.05 μm in order not unduly to increase thermal capacity and conductance. This latter consideration similarly applies both to the layer of insulating material and to the layer of electrically conductive material. The layer of electrically conductive material may require a minimum thickness of about 0.02 μm in order to ensure electrical continuity, and the maximum thickness should similarly preferably not exceed 0.05 μm.

Figure 2:
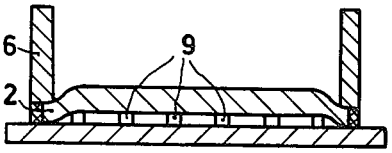
FIG. 2 shows an arrangement for providing further support for the membrane.

The membrane can if necessary be further supported by, for example, a number of posts bearing against the surface of the membrane opposite to that on which the pyroelectric material is supported. Such further support is not in general required to aid the membrane in supporting the load of the various layers formed on it by reducing the spacing between supported regions of the membrane (the strength of a 0.1 μm thick polyimide membrane should be entirely adequate for any reasonable diameter), but rather to increase its rigidity and hence reduce flexing or oscillation due to external mechanical forces. This can suitably be provided by an arrangement such as that shown schematically in FIG. 2 whereby the membrane is tensioned. The further supports 9 may be an integral part of the target assembly, or may be incorporated in the tube in which the target is used, for example being formed by etching of the inner surface of the entrance window. The necessity for the supports and a suitable spacing will depend on the material, thickness and width of the membrane; a membrane of size sufficient to support an active target area of 24 mm × 18 mm will of course be more likely to require support than the above-described target with an effective diameter of not more than 17.5 mm.

A lower limit to the desirable thickness of the pyroelectric material in a target may be set by the fact that the target is capacitive, and the capacitance increases as the thickness decreases: when the "image" recorded by the target is read-out by a scanning electron beam, the time constant of (beam resistance) x (target capacitance) must of course be substantially less than the frame scan period in order for the stored charge to be efficiently read-out. TGS or triglycine fluoroberyllate which are partly or wholly deuterated may be better than undeuterated TGS in this respect since they have a lower dielectric constant, enabling the use of thinner layers with the same capacitance per unit area. Moreover, the effective pyroelectric coefficient appears to be smaller than normal in very thin layers; for example, the pyroelectric coefficient of a 0.5 μm thick layer of TGS has been measured as being roughly half that of bulk polycrystalline TGS. This last point will of course also be relevant to detectors.

An upper limit to the thickness of pyroelectric material in a target may be set by the difficulty of obtaining thick photoresist grid lines (5, FIG. 1*c*) of narrow width. For thick layers, it may accordingly be necessary to increase the width of the gaps between adjacent portions of the mosaic (defined by the photoresist lines), and the dimensions of the mosaic in the target of FIG. 1 may for example be increased proportionately to maintain the value of the ratio $R_2$.

It may also be mentioned that the Curie temperature of the polycrystalline TGS has been measured as being higher than that of single-crystal TGS, namely as about 60° C.

Figure 3:
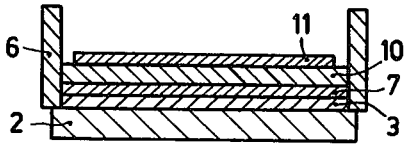
FIG. 3 shows a detector embodying the invention.

A pyroelectric detector embodying the invention can be made by a method analogous to that described above for a target, with appropriate simplification and modification, as follows:

A plastics film is prepared on a glass support and cured by heating. A nickel/chromium alloy electrode a few hundred Angstroms thick is deposited on the membrane. A metal ring of appropriate size is cemented to the face surface of the membrane, and the glass support removed with hydrofluoric acid. A very thin nucleating layer of aluminum is vapour-deposited over the electrode, and a layer of TGS is formed on the aluminum from an aqueous solution of TGS which wets only that part of the surface of the membrane covered with aluminum. Finally, a second electrode, which may consist of successive layers of nickel-chromium alloy and of aluminum, is vapour-deposited on the TGS. The finished detector is shown in FIG. 3, which shows the membrane 2, first electrode 3, metal ring 6, aluminum nucleating layer 7, TGS layer 10, and second electrode 11.

If desired, after the metal ring has been secured to the membrane, a second metal ring with an outer diameter smaller than the inner diameter of the first ring can be cemented concentrically to the opposite surface of the membrane, i.e., the surface which was originally in contact with the glass; the portion of the membrane extending radially beyond the second ring, together with the attached first ring, is then cut away. Portions of the electrodes can in this case extend to the periphery of the membrane, being on the opposite surface thereof to the ring. Electrical connection from the electrodes to an amplifier is readily made; one of the electrodes can be conductively connected to the ring. The use of a second ring can of course also be applied to making a target.

For a target for a thermal-image camera tube, the choice of suitable thicknesses for the pyroelectric material and for the membrane, of the shape and size of the portions of pyroelectric material, and of the width of the gaps between the portions, in a complex matter which is dependent on, inter alia, the desired resolution, MTF and sensitivity of the camera. These three criteria are related to, inter alia:

the value of the ratio $R_1$ of the thickness of the pyroelectric material to that of the membrane;

the value of the ratio $R_2$ of the width of the portions to the width of the gaps between them;

the thermal diffusivity K (and the thermal capacity) of the pyroelectric material, of the membrane and of any other material supported thereon (such as an electrically conductive layer);

the resolution and efficiency of the optical system of the camera;

the manner and rate of varying the radiation incident on the target.

As a rough approximation, the effective lateral thermal conductivity of the substrate, $k_{eff}$, is given by the relationship $$k_{eff} = k_s R_2 / R_1$$

where $k_s$ is the thermal conductivity of the material of the substrate (i.e., neglecting the thermal conductivity of layers intermediate the pyroelectric material and the substrate). The value of $R_2/R_1$ is suitably less than 0.5. Thus, if for example $R_2 = 6$ and $R_1 = 20$, $$k_{eff} = 0.3\ k_s$$

and with a polyimide resin membrane which has a thermal conductivity roughly one-third that of TGS, the effective lateral thermal conductivity is roughly one-tenth that of a continuous (i.e., not a mosaic) self-supporting target of TGS.

The desired resolution (for example in directions parallel and perpendicular to the lines of scanning of an electron beam in the camera tube) will affect the choice of shape and size of the portions of pyroelectric material. A regular array of portions, with a fairly high packing density for good sensitivity, is desirable. The MTF increases with decreasing resolution, with increasing $R_1$, with decreasing $R_2$, with decreasing K, with increasing optical efficiency, and with increasing chopping frequency. The sensitivity increases with decreasing thickness of both the pyroelectric material and the membrane, and with increasing $R_2$. A calculated relationship between MTF, resolution, chopping frequency and thermal diffusivity is displayed in FIG. 5 of the above-mentioned article by Holeman and Wreathall; it should be borne in mind that the effective thermal diffusivity of a mosaic target embodying the invention is of course generally lower than that of a continuous, single-crystal target, as indicated by the above consideration of effective lateral thermal conductivity.

The thickness of the membrane may for example be in the range of 0.05 – 0.5 μm. Low thicknesses are of somewhat less importance for detectors, where the main effect of the thickness is on sensitivity, than for targets, where both sensitivity and lateral thermal conductivity (and hence resolution and/or MTF) are affected.

The thickness of the electrically conductive layer in a target for a vidicon-type image tube must be such that the electrical resistance of the layer is of course much less than the resistance of the scanning electron beam (which may for example be 2 mΩ). However, its thermal conductance should preferably be significantly less than that of the substrate in order not to seriously impair the relative thermal isolation of adjacent portions of pyroelectric material. The thickness and/or material of the electrically conductive layer is suitably chosen within the limits set by these desiderata so that the absorption by the layer of radiation of the wavelengths of interest appropriately complements the absorption by the pyroelectric material and may thus eliminate the necessity for an additional radiation-absorbing layer. A resistance within the range of $10^3$ – $10^5$ ohms per square may be appropriate. However, in certain cases (for example if the layer of pyroelectric material is very thin), it may be desirable to provide such an additional absorbing layer which may consist, for example, of gold black with up to about 100 μgm/sq.cm. This layer should of course preferably have a low thermal capacitance and conductance.

The electrode layers and, if necessary, an additional layer may analogously be used for optical absorption in a detector, but the electrical resistance of the electrodes and the thermal conductances of these layers will in general be much less significant.

For a detector, the main criterion of performance will in general be sensitivity; angular resolution may also be of importance for certain applications. As will be appreciated from the above consideration of a target, the main factors affecting sensitivity will be the thicknesses of the pyroelectric material and the membrane, the surface areas of the pyroelectric material and the electrodes, and the chopping frequency.

We claim:

1. A pyroelectric detector comprising a substrate, supporting a thin, solid layer of pyroelectric material selected from the group comprising TGS and triglycine fluoroberyllate which are partly or wholly deuterated and a layer of nucleating material selected from the group consisting of aluminum, titanium, matt carbon, magnesium fluoride aluminum oxide, and silica and wettable by an aqueous solution of the pyroelectric material and to which the pyroelectric material adheres intermediate the pyroelectric layer and the substrate.

2. A pyroelectric detector as claimed in claim 1 in which the thickness of the pyroelectric layer is between about 0.5 and 5 μm.

3. A pyroelectric detector as claimed in claim 2 in which the substrate consists of a synthetic plastic material having a thickness between about 0.05 and 0.3 μm, a low thermal capacity and a low thermal conductance parallel to the surface thereof supporting the pyroelectric material.

4. A pyroelectric detector as claimed in claim 3 in which the substrate consists of a polyimide.

5. A pyroelectric detector as claimed in claim 2 in which the substrate has a low thermal capacity and the ratio $R_1$ of the thickness of the pyroelectric layer to the thickness of the substrate is not substantially less than 10.

6. A pyroelectric detector as claimed in claim 1 in which the thickness of the nucleating layer intermediate the pyroelectric layer and the substrate is between about 0.01 and 0.05 μm.

7. A pyroelectric target for a thermal-image camera tube comprising a membrane supporting a first layer of nucleating material selected from the group consisting of aluminum, titanium, matt carbon magnesium fluoride aluminum oxide, and silica and wettable by a solution of a pyroelectric material, an aqueous second layer of solid pyroelectric material adherent on and covering the first layer, said membrane having a low thermal capacity and a low thermal conductance parallel to the surface thereof supporting the pyroelectric material, said second layer having a thickness between about 0.5 and 5 μm and comprising a mosaic of spaced portions of pyroelectric material.

8. A pyroelectric detector for a thermal-imaging tube as claimed in claim 7 in which the ratio $R_1$ of the thickness of the layer of pyroelectric material to the thickness of the membrane is not substantially less than 10.

9. A pyroelectric detector for a thermal-imaging tube as claimed in claim 7 in which the membrane consists of electrically insulating material and supports a substantially continuous layer of electrically conductive material intermediate the membrane and the pyroelectric material, the portions of the electrically conductive material between adjacent portions of pyroelectric material being covered by an electrically insulating material.

10. A pyroelectric detector for a thermal-imaging tube as claimed in claim 7 in which the mosaic comprises a regular array of substantially uniform portions of pyroelectric material and the ratio $R_2$ between a width of each portion and the gap between adjacent portions is not substantially less than 5 or substantially greater than 12.

11. A pyroelectric target for a thermal-imaging tube as claimed in claim 7 in which the mosaic comprises a regular array of substantially uniform portions of pyroelectric material in which the ratio $R_2/R_1$ is less than 0.5, $R_1$ being the ratio of the thickness of the layer of pyroelectric material to the thickness of the membrane and $R_2$ being the ratio between the width of each portion and the gap between adjacent portions of the mosaic.

12. A pyroelectric detector for a thermal-imaging tube as claimed in claim 6 wherein each portion has a width between about 20–30 μm.

* * * * *